US011469016B2

(12) United States Patent
Kakoki et al.

(10) Patent No.: US 11,469,016 B2
(45) Date of Patent: Oct. 11, 2022

(54) R-T-B BASED SINTERED MAGNET

(71) Applicant: TDK Corporation, Tokyo (JP)

(72) Inventors: Ayato Kakoki, Tokyo (JP); Makoto Iwasaki, Tokyo (JP); Tetsuya Hidaka, Tokyo (JP); Takuma Hayakawa, Tokyo (JP)

(73) Assignee: TDK Corporation, Tokyo (JP)

( * ) Notice: Subject to any disclaimer, the term of this patent is extended or adjusted under 35 U.S.C. 154(b) by 148 days.

(21) Appl. No.: 16/909,351

(22) Filed: Jun. 23, 2020

(65) Prior Publication Data

US 2020/0321151 A1 Oct. 8, 2020

Related U.S. Application Data

(62) Division of application No. 15/656,284, filed on Jul. 21, 2017, now abandoned.

(30) Foreign Application Priority Data

Jul. 25, 2016 (JP) ..... JP2016-145628

(51) Int. Cl.
*H01F 1/057* (2006.01)
*B22F 9/04* (2006.01)
(Continued)

(52) U.S. Cl.
CPC ..... *H01F 1/0577* (2013.01); *B22F 3/16* (2013.01); *B22F 9/04* (2013.01); *C22C 28/00* (2013.01); *C22C 30/02* (2013.01); *C22C 38/002* (2013.01); *C22C 38/005* (2013.01); *C22C 38/06* (2013.01); *C22C 38/10* (2013.01); *C22C 38/14* (2013.01);
(Continued)

(58) Field of Classification Search
None
See application file for complete search history.

(56) References Cited

U.S. PATENT DOCUMENTS 6,312,494 B1 11/2001 Tokoro et al.
2010/0282371 A1 11/2010 Sagawa et al.
(Continued)

FOREIGN PATENT DOCUMENTS

CN 104395971 A 3/2015
CN 104715877 A 6/2015
(Continued)

OTHER PUBLICATIONS

Machine translation of JP 2002-327255A. (Year: 2002).*
(Continued)

*Primary Examiner* — Xiaowei Su
(74) *Attorney, Agent, or Firm* — Faegre Drinker Biddle & Reath LLP

(57) ABSTRACT

An R-T-B based sintered magnet containing a first heavy rare earth element, in which R includes Nd, T includes Co and Fe, the first heavy rare earth element includes Tb or Dy, the R-T-B based sintered magnet has a region in which a concentration of the first heavy rare earth element decreases from the surface toward the inside, a first grain boundary phase which contains the first heavy rare earth element and Nd but does not contain Co is present in one cross section including the region, and an area occupied by the first grain boundary phase in one cross section including the region is 1.8% or less.

9 Claims, 4 Drawing Sheets

(51) Int. Cl.

| | |
|---|---|
| ***H01F 41/02*** | (2006.01) |
| ***C22C 38/00*** | (2006.01) |
| ***C22C 38/06*** | (2006.01) |
| ***C22C 38/16*** | (2006.01) |
| ***C22C 38/14*** | (2006.01) |
| ***C22C 38/10*** | (2006.01) |
| ***B22F 3/16*** | (2006.01) |
| ***C22C 28/00*** | (2006.01) |
| ***C22C 30/02*** | (2006.01) |

(52) U.S. Cl.

CPC ..... *C22C 38/16* (2013.01); *H01F 41/0293* (2013.01); *B22F 2009/044* (2013.01); *B22F 2201/11* (2013.01); *B22F 2202/05* (2013.01); *B22F 2301/45* (2013.01); *B22F 2998/10* (2013.01); *B22F 2999/00* (2013.01); *C22C 2202/02* (2013.01)

(56) References Cited

U.S. PATENT DOCUMENTS

| | | | |
|---|---|---|---|
| 2013/0169394 | A1 | 7/2013 | Sagawa et al. |
| 2014/0062631 | A1* | 3/2014 | Sagawa ..... C22C 33/0278 335/302 |
| 2015/0170810 | A1 | 6/2015 | Miwa et al. |
| 2017/0062127 | A1 | 3/2017 | Yi et al. |
| 2017/0221615 | A1 | 8/2017 | Chen et al. |

FOREIGN PATENT DOCUMENTS

| | | | |
|---|---|---|---|
| CN | 105185497 | A | 12/2015 |
| CN | 105469973 | A | 4/2016 |
| JP | 2009-170541 | A | 7/2009 |
| JP | 2013-191276 | A1 | 12/2013 |
| JP | 2002/327255 | A | 11/2015 |
| JP | 2016-129249 | A | 7/2016 |

OTHER PUBLICATIONS

Li, Japanese Journal of Applied Physics, 2008, vol. 47, No. 10, p. 7876-7878. (Year: 2008).*

"Chinese Masters Theses Full-text Database, Engineering Science and Technology II", May 15, 2013 (with attached English-language translation).

* cited by examiner

Prior Art

R-T-B BASED SINTERED MAGNET

TECHNICAL FIELD

The present invention relates to an R-T-B based sintered magnet.

BACKGROUND

An R-T-B based sintered magnet containing a rare earth element R, a transition metal element T such as Fe or Co, and boron B exhibits excellent magnetic properties. Hitherto, a number of investigations have been carried out in order to improve the residual magnetic flux density (Br) and coercive force (HcJ) of an R-T-B based sintered magnet. It is known that the coercive force and the square shape property in the magnetization curve are improved by setting the amount of the rare earth element that is in a metal state and contained in the R-T-B based sintered magnet before diffusion to a predetermined amount or more, for example, in the case of diffusing a heavy rare earth element into an R-T-B based sintered magnet (Japanese Unexamined Patent Publication No. 2009-170541).

However, as a result of intensive investigations by the present inventors, it has been revealed that a part of heavy rare earth elements diffused in the sintered magnet does not contribute to the improvement of coercive force in a conventional R-T-B based sintered magnet. First, as illustrated in FIG. 4, a great number of voids 101 are present in a conventionally used R-T-B based sintered magnet 102. A part of heavy rare earth elements is trapped in the void 101 in the case of diffusing a heavy rare earth element in such an R-T-B based magnet 102. The heavy rare earth element trapped in the void 101 does not contribute to the improvement of coercive force. Hence, it is impossible to achieve the improvement of coercive force to an extent to be expected from the amount of heavy rare earth element used as a result. In addition, loss in terms of cost-effectiveness is also great since heavy rare earth elements are expensive.

SUMMARY

The present invention has been made in view of the above problems, and an object thereof is to provide an R-T-B based sintered magnet having an excellent coercive force with respect to the amount of heavy rare earth element used.

In the R-T-B based sintered magnet of the present invention, R includes Nd, T includes Co and Fe, and a total area of voids in one cross section of the R-T-B based sintered magnet is 0.2% or less of an area of the cross section.

The R-T-B based sintered magnet of the present invention is an R-T-B based sintered magnet containing a first heavy rare earth element, in which R includes Nd, T includes Co and Fe, the first heavy rare earth element includes Tb or Dy, the R-T-B based sintered magnet has a region in which a concentration of the first heavy rare earth element decreases from the surface toward the inside, a first grain boundary phase which contains the first heavy rare earth element and Nd but does not contain Co is present in one cross section including the region, and an area occupied by the first grain boundary phase in one cross section including the region is 1.8% or less.

It is preferable that a second grain boundary phase which contains Nd and Co but does not contain the first heavy rare earth element is further present in the cross section and a ratio of an area of the first grain boundary phase to an area of the second grain boundary phase is 2.0 or less.

It is preferable that the R-T-B based sintered magnet further contains a second heavy rare earth element and the second heavy rare earth element is substantially uniformly contained over the entire grain boundary phase of the R-T-B based sintered magnet and is a different kind of element from the first heavy rare earth element.

It is preferable that a second grain boundary phase of a multiparticle grain boundary phase which contains Nd and Co and has a substantially uniform concentration of the first heavy rare earth element is further present in the region and a ratio of an area of the first grain boundary phase to an area of the second grain boundary phase is 2.0 or less.

In addition, the sintered magnet of the present invention is a sintered magnet in which a first heavy rare earth element contained in a heavy rare earth compound is diffused from the surface toward the inside of an R-T-B based sintered magnet by attaching the heavy rare earth compound to at least a part of the surface of the R-T-B based sintered magnet and heating the heavy rare earth compound, and in the R-T-B based sintered magnet, R includes Nd, T includes Co and Fe, the first heavy rare earth element includes Tb or Dy, a first grain boundary phase which contains the first heavy rare earth element and Nd but does not contain Co is present in one cross section including a region having the first heavy rare earth element diffused, an area occupied by the first grain boundary phase in the cross section is 1.8% or less, a second grain boundary phase which contains Nd and Co but does not contain the first heavy rare earth element is further present in the cross section, and a ratio of an area of the first grain boundary phase to an area of the second grain boundary phase is 2.0 or less. It is preferable that the R-T-B based sintered magnet contains a second heavy rare earth element.

According to the present invention, it is possible to provide an R-T-B based sintered magnet having an excellent coercive force with respect to the amount of heavy rare earth element used.

DETAILED DESCRIPTION

<Sintered Magnet Before Diffusion>

Figure 1B:
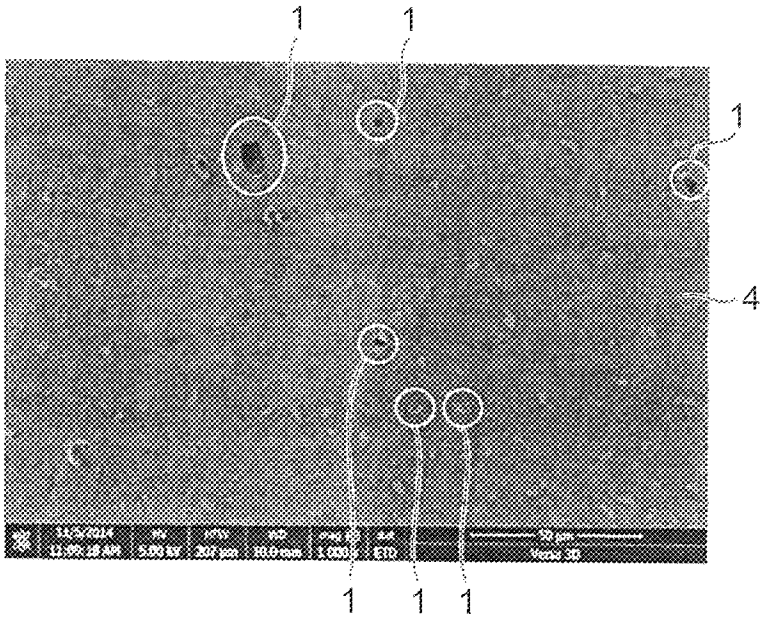
FIGS. 1A and 1B are SEM photographs of sintered magnets before diffusion of Example 1 and Comparative Example 1.

The R-T-B based sintered magnet of the present embodiment contains Nd as the rare earth element R and Fe and Co as the transition metal element T. Incidentally, the R-T-B sintered magnet in which a heavy rare earth element is not yet diffused is also referred to as the sintered magnet before diffusion in order to distinguish it from the R-T-B based sintered magnet (sintered magnet after diffusion) in which a heavy rare earth element is diffused and which will be described later.

The rare earth element R may include at least one kind of rare earth element selected from the group consisting of Sc, Y, La, Ce, Pr, Pm, Sm, Eu, Gd, Tb, Dy, Ho, Er, Tm, Yb, and Lu other than Nd. Pr or Dy and Tb are preferable as the rare earth element other than Nd.

In the sintered magnet before diffusion of the present embodiment, the content of R is preferably from 29 to 33 mass % and more preferably from 29.5 to 31.5 mass % with respect to the total mass of the sintered magnet before diffusion. When the content of R is 29 mass % or more, a sintered magnet before diffusion having a high coercive force is likely to be obtained when a sintered magnet after diffusion is produced from the sintered magnet before diffusion. Meanwhile, the R-rich nonmagnetic phase does not increase too many and the residual magnetic flux density of the sintered magnet tends to be improved in the sintered magnet after diffusion produced from the sintered magnet before diffusion when the content of R is 33 mass % or less.

In the sintered magnet before diffusion of the present embodiment, the content of Nd is preferably from 15 to 33 mass % and even more preferably from 20 to 31.5 mass % with respect to the total mass of the sintered magnet before diffusion. The coercive force and the residual magnetic flux density tend to be improved when the content of Nd in the sintered magnet before diffusion is from 15 to 33 mass %. In addition, the content of element Pr in the sintered magnet before diffusion of the present embodiment is preferably from 5 to 10 mass % with respect to the total mass of the sintered magnet before diffusion from the viewpoint of cost. Dy or Tb may be added to the sintered magnet before diffusion according to the required coercive force and the content thereof is preferably from 0 to 10 mass % with respect to the total mass of the sintered magnet before diffusion.

The sintered magnet before diffusion may contain elements other than Nd, Fe, Co, and Cu, and it may contain Al, Si, Mn, Ni, Ga, Sn, Bi, Ti, V, Cr, Zr, Nb, Mo, Hf, Ta, and W. In particular, it is preferable to contain Al, Zr, or Ga. The content of Al in the sintered magnet before diffusion of the present embodiment is preferably from 0.05 to 0.3 mass % and even more preferably from 0.15 to 0.25 mass % with respect to the total mass of the sintered magnet before diffusion. The coercive force and residual magnetic flux density of the sintered magnet after diffusion produced from the sintered magnet before diffusion tend to be improved when the content of Al in the sintered magnet before diffusion is from 0.05 to 0.3 mass %.

In addition, the content of Zr or Ga in the sintered magnet before diffusion is preferably from 0.05 to 0.3 mass % and more preferably from 0.1 to 0.2 mass % from the viewpoint of further decreasing voids in the sintered magnet before diffusion.

The content of Co is preferably from 0.5 to 3 mass % and more preferably from 1.0 to 2.5 mass % from the viewpoint of further decreasing voids in the sintered magnet before diffusion. In addition, the content of Cu is preferably from 0.05 to 0.3 mass % and more preferably from 0.15 to 0.25 mass %. Fe is the remainder other than the essential elements and arbitrary elements in the sintered magnet before diffusion of the present embodiment, and the content of Fe is preferably from 50 to 73 mass %.

The content of B in the sintered magnet before diffusion is preferably from 0.5 to 5 mass %, more preferably from 0.8 to 1.1 mass %, and even more preferably from 0.85 to 1.0 mass %. The coercive force of the sintered magnet before diffusion tends to be improved when the content of B is 0.5 mass % or more, and formation of a B-rich nonmagnetic phase in the sintered magnet before diffusion is suppressed and the residual magnetic flux density of the sintered magnet before diffusion tends to be improved when the content of B is 5 mass % or less.

The sintered magnet before diffusion of the present embodiment mainly includes the main phase particles constituted by $R_2T_{14}B$ and an R-rich phase that is present in the grain boundary phase between the main phase particles and has a higher R concentration than the main phase particles. The concentration of R in the R-rich phase is, for example, 20 at % or more.

Here, the element concentrations of Nd, Cu, and Co in the cross section of the sintered magnet before diffusion can be measured by, for example, a three-dimensional atom probe (3DAP).

The average particle diameter of the main phase particles contained in the sintered magnet before diffusion is preferably from 1 to 5 μm and more preferably from 2.5 to 4 μm. The particles of heavy rare earth element are likely to be uniformly attached to the surface of the sintered magnet before diffusion when a heavy rare earth element is diffused into the sintered magnet before diffusion when the particle diameter of the main phase particles is 5 μm or less. The particle diameter of the main phase particles can be controlled by the particle diameter of the alloy for magnet after grinding, the sintering temperature, the sintering time, and the like.

The voids in the sintered magnet before diffusion are pores present at the multiparticle grain boundaries (grain boundaries surrounded by three or more main phase particles) and trap heavy rare earth elements when the heavy rare earth elements are diffused into the sintered magnet before diffusion. The amount of heavy rare earth elements to be trapped is proportional to the volume of voids, and it is thus more preferable as the volume per one void is smaller and the total number of voids is smaller.

In the sintered magnet before diffusion of the present embodiment, the total area of voids in one cross section of the sintered magnet before diffusion is 0.2% or less of the area of the cross section. Incidentally, in the following description, the ratio of the total area of voids to the area of the cross section is also simply referred to as the void occupancy rate. In the sintered magnet before diffusion of the present embodiment, the total area of voids per constant cross-sectional area is small. Hence, the number of heavy rare earth elements to be trapped into the voids is smaller when a heavy rare earth element such as Tb or Dy is diffused into the sintered magnet before diffusion and an R-T-B based sintered magnet having an excellent coercive force with respect to the amount of heavy rare earth element used can be obtained. The void occupancy rate may be 0.19% or less, 0.18% or less, 0.17% or less, 0.16% or less, 0.15% or less, 0.14% or less, 0.13% or less, 0.12% or less, 0.11% or less, 0.10% or less, 0.09% or less, 0.08% or less, 0.07% or less, 0.06% or less, 0.05% or less, 0.04% or less, 0.03% or less, 0.02% or less, or 0.01% or less. Incidentally, the lower limit value of the void occupancy rate is not particularly limited, but it may be, for example, 1 ppm or 10 ppm.

Here, examples of the method of calculating the total area of voids in one cross section may include the following ones. First, a photograph of one cross section of the sintered magnet before diffusion is acquired. The sum of the areas of voids is calculated through image recognition of the voids in the cross section. Incidentally, the sintered magnet before diffusion of the present embodiment includes one or more cross sections having a void occupancy rate of 0.2% or less, but the void occupancy rate may be 0.2% or less in an arbitrary cross section, or for example, the average value of the void occupancy rates of nine cross-sectional photographs may be 0.2% or less.

In the sintered magnet before diffusion of the present embodiment, the number of voids in one cross section or a rectangular region having a short side of 500 μm or more in the cross section of the sintered magnet before diffusion is preferably 30 or fewer and more preferably 12 or fewer per 10000 $\mu m^2$ cross section. It is even more preferably 5 or fewer. In addition, the average area of voids is preferably 0.7 $\mu m^2$ or less and more preferably 0.6 $\mu m^2$ or less. The average area of voids refers to the average area per one void in the cross section.

<Sintered Magnet after Diffusion>

The R-T-B based sintered magnet of the present embodiment includes Nd as the rare earth element R and Fe and Co as the transition metal element T. In addition, the R-T-B based sintered magnet of the present embodiment is one obtained by diffusing the first heavy rare earth element including Tb or Dy into the sintered magnet before diffusion described above. Hence, the composition other than the heavy rare earth element introduced by diffusion can be considered to be the same as that of the sintered magnet before diffusion described above. Incidentally, in the following description, the R-T-B based sintered magnet of the present embodiment is also referred to as a sintered magnet after diffusion. The first a heavy rare earth element is one that is diffused in the R-T-B based sintered magnet in the diffusion step to be described later, and the sintered magnet after diffusion thus has a region in which the concentration of the first heavy rare earth element decreases from the surface toward the inside.

Examples of the first heavy rare earth element may include Gd, Ho, Er, Tm, Yb, and Lu as a heavy rare earth element other than Tb or Dy. The content of the heavy rare earth element introduced by diffusion is preferably from 0.1 to 2.0 mass % and more preferably from 0.2 to 1.0 mass % with respect to the entire sintered magnet after diffusion.

The sintered magnet after diffusion of the present embodiment has a region (hereinafter also referred to as the diffusion portion) in which the concentration of the first heavy rare earth element decreases from the diffusion surface toward the inside of the sintered magnet. When viewed from the diffusion surface, the thickness of the diffusion portion may be from 0.01 to 100 mm or from 0.1 to 5.0 mm. In addition, it may be from 1 to 50% or from 5 to 20% of the magnet thickness.

In the sintered magnet after diffusion of the present embodiment, the diffusion surface may be all the surfaces of the sintered magnet after diffusion or some of the surfaces. More specifically, all six surfaces may be the diffusion surface, only two opposing surfaces may be the diffusion surface, or only one surface may be the diffusion surface in the case of a sintered magnet after diffusion of rectangular parallelepiped. On the surface on which the diffusion surface is formed, the diffusion surface may be the entire surface, or the diffusion surface may be provided at one place of the surface or discretely provided at plural places of the surface. A sintered magnet after diffusion in which all the six surfaces of the rectangular parallelepiped are the diffusion surface is preferable since the improvement range of the coercive force at the corner portion can be increased. In addition, the amount of heavy rare earth element used is small in a case in which the diffusion surface is formed on some of the surfaces.

In the diffusion portion of the sintered magnet after diffusion of the present embodiment, the first grain boundary phase is present in one cross section perpendicular to the diffusion surface. The first grain boundary phase contains Nd and the first heavy rare earth element but does not contain Co. The ratio of the total area of the first grain boundary phases to the area of the cross section (also referred to as the occupancy rate of the first grain boundary phase) may be 1.8% or less, 1.7% or less, 1.6% or less, 1.5% or less, 1.4% or less, 1.3% or less, 1.2% or less, 1.1% or less, 1.0% or less, 0.9% or less, 0.8% or less, 0.7% or less, 0.6% or less, 0.5% or less, 0.4% or less, or 0.3% or less. The lower limit value of the occupancy rate of the first grain boundary phase is not particularly limited, but it can be, for example, 25 ppm. The first grain boundary phase does not contain Co present in the grain boundary phase in the sintered magnet after diffusion, and it is thus considered that the first grain boundary phase is formed as the heavy rare earth element is trapped into the void of the sintered magnet before diffusion. Hence, the number of the first grain boundary phases in the sintered magnet after diffusion also decreases as the number of the voids in the sintered magnet before diffusion decreases. The first heavy rare earth element contained in the first grain boundary phase does not contribute to the improvement of coercive force. In the sintered magnet after diffusion of the present embodiment, the ratio of the total area of the first grain boundary phases in one cross section perpendicular to the diffusion surface of the sintered magnet after diffusion is small, and the amount of heavy rare earth elements that do not contribute to the improvement of coercive force (namely, trapped in the voids) is also small. Accordingly, the coercive force of the sintered magnet after diffusion of the present embodiment with respect to the amount of heavy rare earth element used is improved. Incidentally, the first grain boundary phase is formed as the heavy rare earth element is mixed with elements in the vicinity of the voids when the heavy rare earth element is trapped into the voids. Hence, the cross-sectional area of the first grain boundary phase is greater than the cross-sectional area of the corresponding void.

Examples of the method of calculating the total area of the first grain boundary phases may include the following methods. First, an electron probe micro analysis (EPMA) image of one cross section perpendicular to the diffusion surface of the sintered magnet is acquired. From the EPMA image thus obtained, a region which contains the first heavy rare earth element and Nd but does not contain Co is specified, and this region is defined as the first grain boundary phase. The area of the EPMA image may be from 2500 to 40000 $\mu m^2$ and the total area of a plurality of EPMA images may be from 10000 to 400000 $\mu m^2$. The area of the first grain boundary phase thus specified is determined through image recognition, and the sum of the areas of the first grain boundary phases in the cross section is calculated. Incidentally, in the first grain boundary phase, the content of Nd and Pr is, for example, preferably 18 at % or more, more preferably 20 at % or more, and even more preferably 22 at % or more in total. In addition, in the first grain boundary phase, the content of the first heavy rare earth element is, for example, preferably 1.2 at % or more, more preferably 1.4 at % or more, and even more preferably 1.6 at % or more. In addition, the expression "Co is not contained" means that the content of Co is lower than in the main phase, and for example, it is preferably 0.6 at % or less, more preferably 0.5 at % or less, and even more preferably 0.4 at % or less. The content of Nd is preferably 9 at % or more, more preferably 10 at % or more, and even more preferably 11 at % or more.

The sintered magnet after diffusion of the present embodiment has one or more cross sections which has an occupancy rate of the first grain boundary phase of 1.8% or less and is perpendicular to the diffusion surface, but the occupancy rate of the first grain boundary phase in an arbitrary cross section perpendicular to the diffusion surface may be 1.8% or less.

In the sintered magnet after diffusion of the present embodiment, the number of the first grain boundary phases in one cross section of the sintered magnet after diffusion is preferably 34 or fewer and more preferably 22 or fewer per 10000 $\mu m^2$ cross section. It is even more preferably 11 or fewer. In addition, the average area of the first grain boundary phase is, for example, from 2 to 10 $\mu m^2$. Incidentally, the average area of the first grain boundary phase refers to the average area per one first grain boundary phase in the cross section.

In the one perpendicular cross section of the sintered magnet after diffusion of the present embodiment, a second grain boundary phase which contains Nd and Co but does not contain the first heavy rare earth element may be present. The second grain boundary phase has a composition similar to that before diffusion of the heavy rare earth element, and it is thus considered that the second grain boundary phase is derived from the multiparticle grain boundary phase (the grain boundary phase surrounded by three or more main phase particles) of the sintered magnet before diffusion. Incidentally, in the present specification, a region in which the shortest distance from the surface of one main phase particle to the surface of another main phase particle is 30 nm or more in the grain boundary phase between two main phases is referred to as the multiparticle grain boundary phase. The multiparticle grain boundary phase may be a region in which the shortest distance is 50 nm or more or a region in which the shortest distance is 100 nm or more. From the viewpoint of the coercive force and the residual magnetic flux density, the ratio of the total area of the second grain boundary phases to the area of the perpendicular cross section (also referred to as the occupancy rate of the second grain boundary phase) is preferably from 1 to 10% and more preferably from 1 to 3%. In addition, the ratio of the area of the first grain boundary phase to the area of the second grain boundary phase (area of second grain boundary phase/area of first grain boundary phase) may be 2.0 or less, 1.9 or less, 1.8 or less, 1.7 or less, 1.6 or less, 1.5 or less, 1.4 or less, 1.3 or less, 1.2 or less, 1.1 or less, 1.0 or less, 0.9 or less, 0.8 or less, 0.7 or less, 0.6 or less, 0.5 or less, 0.4 or less, 0.3 or less, 0.2 or less, or 0.15 or less. The expression "the ratio is 2.0 or less" means that the amount of heavy rare earth element trapped in the void (namely, contained in the first grain boundary phase) is small, thus the coercive force with respect to the amount of heavy rare earth element used is further improved.

The sintered magnet after diffusion of the present embodiment may contain the heavy rare earth element (hereinafter referred to as the second heavy rare earth element) that is originally contained in the sintered magnet before diffusion. The second heavy rare earth element is derived from the raw material alloy when producing the sintered magnet before diffusion, and it is thus contained in the grain boundary phase of the sintered magnet after diffusion at a substantially uniform concentration unlike the first heavy rare earth element. Examples of the second heavy rare earth element may include Gd, Tb, Dy, Ho, Er, Tm, Yb, and Lu. The second heavy rare earth element may be a different kind from or the same kind as the first heavy rare earth element. Examples of the method of measuring the concentration of the second heavy rare earth in the grain boundary phase may include a method using a three-dimensional atom probe (3DAP). Here, with regard to the concentration of the second heavy rare earth element, the expression "to be substantially uniform over the entire grain boundary phase" means that the concentration difference between the highest concentration region and the lowest concentration region is two-fold or less when the entire sintered magnet after diffusion is equally divided into three in the diffusion direction.

In a case in which the second heavy rare earth element and the first heavy rare earth element are the same kind, the second grain boundary phase contains the same kind of element as the first heavy rare earth element. Hence, the second grain boundary phase has a composition similar to that before diffusion of the heavy rare earth element as described above, and it is thus recognized as a multiparticle grain boundary phase which contains Nd and Co and has a substantially uniform concentration of the first heavy rare earth element. Here, with regard to the concentration of the first heavy rare earth element, the expression "to be substantially uniform in the second grain boundary phase" means that the concentration is two-fold or less the average concentration in the grain boundary phase included in a 100 $\mu m^2$ of the magnet cross section.

Incidentally, the cross section includes a region in which the first heavy rare earth element is not diffused (hereinafter referred to as the region B) in some cases. The multiparticle grain boundary phase included in the region B and the second grain boundary phase have substantially the same composition.

Examples of the method of calculating the total area of the second grain boundary phases may include the following methods. First, an EPMA image of one cross section of the sintered magnet after diffusion is acquired. From the EPMA image thus obtained, a region which contains Nd and Co but does not contain the first heavy rare earth element or has a substantially uniform concentration of the first heavy rare earth element is specified, and this region is defined as the second grain boundary phase. The area of the EPMA image may be from 2500 to 40000 $\mu m^2$ and the total area of a plurality of EPMA images may be from 10000 to 400000 $\mu m^2$. The area of the second grain boundary phase thus specified is determined through image recognition, and the sum of the areas of the second grain boundary phases in the cross section is calculated. Incidentally, in the second grain boundary phase, the content of Nd and Pr is, for example, preferably 18 at % or more, more preferably 20 at % or more, and even more preferably 22 at % or more in total. In addition, in the second grain boundary phase, the content of Co is higher than in the main phase, and for example, it is preferably 0.7 at % or more, more preferably 0.8 at % or more, and even more preferably 0.9 at % or more. In addition, the expression "the first heavy rare earth element is not contained" means that the content of the first heavy rare earth element is, for example, preferably less than 1.2 at %, more preferably less than 1.0 at %, and even more preferably less than 0.8 at %. In addition, the expression "the concentration of the first heavy rare earth element is substantially uniform" means that the concentration is two-fold or less the average concentration in the grain boundary phase included in a 100 $\mu m^2$ of the EPMA image. The content of Nd is preferably 9 at % or more, more preferably 10 at % or more, and even more preferably 11 at % or more.

In the sintered magnet after diffusion of the present embodiment, the number of the second grain boundary phases in one cross section of the sintered magnet after diffusion is preferably 31 or more and more preferably 54 or more per 10000 $\mu m^2$ cross section. It is even more preferably 69 or more. In addition, the average area of the second grain boundary phase is, for example, from 2 to 4 $\mu m^2$. Incidentally, the average area of the second grain boundary phase refers to the average area per one second grain boundary phase in the cross section.

<Method of Producing Sintered Magnet Before Diffusion>

First, an R-T-B based alloy containing Nd, Co, and B is prepared as a raw material alloy. The chemical composition of the raw material alloy may be appropriately adjusted according to the chemical composition of the sintered magnet to be finally obtained. The alloy to be prepared may be one kind, or plural kinds of alloys may be used. Incidentally, as the raw material alloy, only an R-T-B based alloy can be used from the viewpoint of cost saving, but an alloy other than the R-T-B based alloy may be concurrently used. Examples of the alloy other than the R-T-B based alloy may include an R-T alloy composed of a rare earth element and a transition metal element. Specific examples of the R-T alloy may include an R—Fe—Al alloy, an R—Fe—Al—Cu alloy, and an R—Fe—Al—Cu—Co—Zr alloy. The amount of the R-T-B based alloy used is set to preferably 80 mass % or more and more preferably 90 mass % or more based on the total mass of the alloys to be used in the case of using a plurality of alloys as the raw material.

The raw material alloy is coarsely crushed into particles having a particle diameter of about several hundred μm. For coarse crushing of the raw material alloy, for example, a coarse crusher such as a jaw crusher, a brown mill, or a stamp mill may be used. In addition, it is preferable to conduct the coarse crushing of the raw material alloy in an inert gas atmosphere. The raw material alloy may be subjected to hydrogen storage crushing. In the hydrogen storage crushing, it is possible to coarsely crush the raw material alloy through self-collapse based on the difference in hydrogen storage capacity between different phases by storing hydrogen in the raw material alloy and then heating the raw material alloy in an inert gas atmosphere.

The coarsely crushed raw material alloy may be finely crushed until the particle diameter thereof reaches 1 to 10 μm. For fine crushing, a jet mill, a ball mill, a vibration mill, a wet attritor, or the like may be used. In fine crushing, additives such as zinc stearate and oleic acid amide may be added to the raw material alloy. This makes it possible to improve the orientation of the raw material alloy at the time of molding.

The crushed raw material alloy is subjected to pressure molding in a magnetic field to be formed into a molded body. The magnetic field at the time of pressure molding may be about from 950 to 1600 kA/m. The pressure at the time of pressure molding is preferably about from 10 to 125 MPa and more preferably about from 50 to 200 MPa. The shape of the molded body is not particularly limited, and it may be a columnar shape, a tabular shape, a ring shape, and the like.

The molded body is sintered in a vacuum or an inert gas atmosphere to obtain a sintered magnet before diffusion. The sintering temperature may be adjusted according to various conditions such as the composition of the raw material alloy, the crushing method, the particle size, and the particle size distribution. The sintering temperature may be from 950 to 1150° C. and it is preferably from 1000 to 1130° C., and the sintering time may be about from 1 to 10 hours. The pressure at the time of sintering may be 5 kPa or less, more preferably 200 Pa or less, and even more preferably 5 Pa or less. The aging treatment may be conducted after sintering. The coercive force as a sintered magnet before diffusion is greatly improved by the aging treatment. In the case of conducting the diffusion treatment, the diffusion treatment is not affected by the aging treatment since the temperature for the diffusion heat treatment is higher than the temperature for the aging treatment.

It is possible to set the void occupancy rate in the sintered magnet before diffusion of the present embodiment to 0.2% or less, for example, by increasing the pressure at the time of pressure molding or conducting calcination in a high vacuum atmosphere at a high temperature. In addition, it is possible to set the void occupancy rate to 0.2% or less by increasing the content of Zr or Ga in the raw material alloy. The content of Zr or Ga in the raw material alloy is preferably from 0.05 to 0.3 mass % and more preferably from 0.1 to 0.2 mass %. It is considered that a heterogeneous phase is formed in the grain boundary phase and buries the voids at the time of sintering when the content of Zr or Ga in the raw material alloy is increased, and the amount of voids can be thus decreased.

The content of oxygen in the sintered magnet before diffusion is preferably 3000 mass ppm or less, more preferably 2500 mass ppm or less, and even more preferably 1000 mass ppm or less. The impurities in the sintered magnet before diffusion to be obtained decrease and the magnetic properties of the sintered magnet are improved as the amount of oxygen is smaller. Examples of the method of decreasing the content of oxygen in the sintered magnet before diffusion may include a method to maintain the raw material alloy in an atmosphere having a low oxygen concentration during the period from hydrogen storage crushing to sintering.

The surface of the sintered magnet before diffusion may be treated with an acid solution after the sintered magnet before diffusion is processed into a desired shape. As the acid solution to be used in the surface treatment, a mixed solution of an aqueous solution of nitric acid, hydrochloric acid, or the like with an alcohol is suitable. Examples of the method of the surface treatment may include immersion of the sintered magnet before diffusion in an acid solution and spraying of an acid solution to the sintered magnet before diffusion. By the surface treatment, it is possible to obtain a clean surface as the contaminants, an oxidized layer, and the like which are attached to the sintered magnet before diffusion are removed and thus to reliably conduct the attachment and diffusion of the heavy rare earth compound particles to be described later. The surface treatment may be conducted while applying ultrasonic waves to the acid solution from the viewpoint of further improving removal of the contaminants, an oxidized layer, and the like.

<Method of Producing Sintered Magnet after Diffusion>

First, a heavy rare earth compound containing a heavy rare earth element is attached to the surface of the sintered magnet before diffusion. The surface to which the heavy rare earth compound is attached becomes the diffusion surface in the sintered magnet after diffusion. As the sintered magnet before diffusion, the sintered magnet before diffusion described above can be used. The heavy rare earth compound contains at least Tb or Dy. Examples of the heavy rare earth compound may include an alloy, an oxide, a halide, a hydroxide, and a hydride, but it is preferable to use a hydride in particular. In the case of using a hydride, only the heavy rare earth element contained in the hydride diffuses into the sintered magnet before diffusion when diffusing the heavy rare earth element. Hydrogen contained in the hydride is released to the outside of the sintered magnet before diffusion when diffusing the heavy rare earth element. Accordingly, impurities derived from the heavy rare earth compound do not remain in the sintered magnet to be finally obtained when a hydride of a heavy rare earth element is used, and a decrease in residual magnetic flux density of the sintered magnet is thus likely to be prevented. Examples of the hydride of a heavy rare earth element may include $DyH_2$, $TbH_2$, or a hydride of Dy—Fe or Tb—Fe. In particular, $DyH_2$ or $TbH_2$ is preferable. In the case of using a hydride of Dy—Fe, Fe also tends to diffuse into the sintered magnet in the heat treatment step.

The heavy rare earth compound to be attached to the sintered magnet before diffusion is preferably particulate, and the average particle diameter thereof is preferably from 0.1 μm to 50 μm and more preferably from 1 μm to 10 μm. Crushing is technically difficult, the yield is poor, and the cost thus increases when the particle diameter of the heavy rare earth compound is less than 100 nm. It is difficult for the heavy rare earth compound to diffuse into the sintered magnet before diffusion and the effect of improving coercive force tends to be not sufficiently obtained when the particle diameter exceeds 50 μm.

Examples of the method of attaching the heavy rare earth compound to the sintered magnet before diffusion may include a method to blow particles of the heavy rare earth compound to the sintered magnet before diffusion as they are, a method to coat the sintered magnet before diffusion with a solution prepared by dissolving the heavy rare earth compound in a solvent, a method to coat the sintered magnet before diffusion with a slurry diffusing agent prepared by dispersing particles of the heavy rare earth compound in a solvent, and a method to deposit the heavy rare earth element onto the sintered magnet before diffusion. Among them, a method to coat the sintered magnet before diffusion with a diffusing agent is preferable. In the case of using a diffusing agent, the heavy rare earth compound can be uniformly attached to the sintered magnet before diffusion and the diffusion of the heavy rare earth element can reliably proceed. Hereinafter, the case of using a diffusing agent will be described.

As a solvent to be used in the diffusing agent, it is preferable to use a solvent capable of uniformly dispersing the heavy rare earth compound but not dissolving it. Examples of the solvent may include an alcohol, an aldehyde, and a ketone, and ethanol is preferable among them. The sintered magnet before diffusion may be immersed in the diffusing agent, or the diffusing agent may be dropped on the sintered magnet before diffusion.

In the case of using a diffusing agent, the content of the heavy rare earth compound in the diffusing agent may be appropriately adjusted according to the target value of the mass concentration of the heavy rare earth element to be diffused. For example, the content of the heavy rare earth compound in the diffusing agent may be from 10 to 50 mass % or from 40 to 50 mass %. The heavy rare earth compound is likely to be uniformly attached to the sintered magnet before diffusion in a case in which the content of the heavy rare earth compound in the diffusing agent is in the above range. In addition, in a case in which the content of the heavy rare earth compound in the diffusing agent is in the above range, the surface of the sintered magnet before diffusion is likely to be smooth and it is thus easy to form plating or the like for improving the corrosion resistance of the sintered magnet before diffusion to be obtained.

The diffusing agent may further contain components other than the heavy rare earth compound if necessary. Examples of other components which may be contained in the diffusing agent may include a dispersant for preventing the aggregation of particles of the heavy rare earth compound.

(Diffusion Step)

The sintered magnet before diffusion having the heavy rare earth compound attached to its surface is subjected to the heat treatment to diffuse the heavy rare earth element into the sintered magnet before diffusion. The temperature for the heat treatment is preferably from 700 to 950° C. The time for the heat treatment is preferably from 5 to 50 hours.

The sintered magnet thus obtained may be further subjected to the aging treatment. The aging treatment contributes to the improvement of magnetic properties (particularly coercive force) of the sintered magnet.

A plating layer, an oxidized layer, a resin layer, or the like may be formed on the surface of the sintered magnet after diffusion. These layers function as a protective layer for preventing deterioration of the magnet.

The sintered magnet after diffusion of the present embodiment can be used in, for example, a motor.

EXAMPLES

<Sintered Magnet Before Diffusion>

First, raw material alloys having the composition 1 or composition 2 presented in Table 1 (mass %) were prepared. The raw material alloys were subjected to hydrogen storage and then heated to 600° C. to obtain coarse powders. Oleic acid amide was added to the coarse powder thus obtained at 0.1 mass % and mixed by using a mixer. After mixing, the mixture was crushed by using a jet mill to obtain an alloy powder. The powder of the raw material alloy thus obtained was molded in a magnetic field of 3T at a pressure of 30 Mpa to obtain a molded body.

Figure 1A:
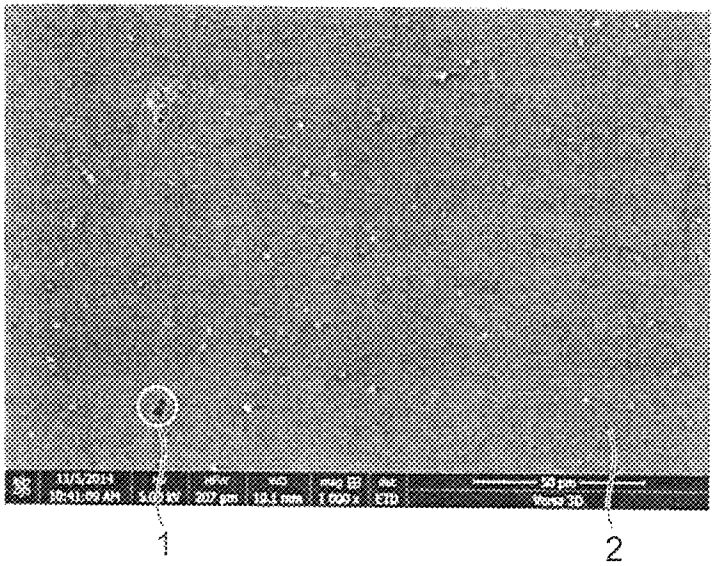

The molded body thus obtained was sintered in an Ar atmosphere at the temperature and pressure presented in Table 2 to obtain a sintered magnet before diffusion. The cross-sectional photographs of the sintered magnets before diffusion of Examples 1 to 5 (Ex. 1 to 5) and Comparative Examples 1 to 3 (Com. Ex. 1 to 3) were acquired, respectively, and the number of voids, the average area, and the total area of the cross section were measured to calculate the void occupancy rate. The results thereof are presented in Table 3. The SEM photographs of the sintered magnets before diffusion of Example 1 and Comparative Example 1 are illustrated in FIGS. 1A and 1B, respectively. In FIG. 1A, the void 1 was almost not observed in the sintered magnet before diffusion 2 of Example 1, but in FIG. 1B, a great number of voids 1 was observed in the sintered magnet before diffusion 4.

TABLE 1

| | Nd | Pr | Dy | B | Al | Co | Cu | Zr | Ga | Fe |
|---|---|---|---|---|---|---|---|---|---|---|
| Composition 1 | 23 | 8 | 0 | 0.95 | 0.2 | 2 | 0.2 | 0.2 | 0.2 | Remainder |
| Composition 2 | 29 | 0 | 1.6 | 0.95 | 0.2 | 0.5 | 0.1 | 0.1 | 0.1 | Remainder |

TABLE 2

| | Conditions for sintering | |
|---|---|---|
| | Sintering temperature | Ar pressure when sintering |
| Example 1 | 1120° C. | 5 Pa |
| Example 2 | 1120° C. | 5 Pa |
| Example 3 | 1100° C. | 50 Pa |
| Example 4 | 1080° C. | 200 Pa |
| Example 5 | 1100° C. | 5 Pa |
| Comparative Example 1 | 1040° C. | 5 kPa |
| Comparative Example 2 | 1040° C. | 5 kPa |
| Comparative Example 3 | 1040° C. | 5 kPa |

TABLE 3

| | | | Ex. 1 | Ex. 2 | Ex. 3 | Ex. 4 | Ex. 5 |
|---|---|---|---|---|---|---|---|
| | | Raw material alloy | 1 | 1 | 1 | 1 | 2 |
| Base material | Entire visual field | Area ($\mu m^2$) | 42085 | 42085 | 42085 | 42085 | 42085 |
| | Voids | Number | 9 | 9 | 24 | 51 | 22 |
| | | Average area ($\mu m^2$) | 0.45 | 0.45 | 0.53 | 0.66 | 0.51 |
| | | Total area ($\mu m^2$) | 4.04 | 4.04 | 12.72 | 33.66 | 11.22 |
| | | Void occupancy rate (%) | 0.010% | 0.01% | 0.03% | 0.08% | 0.03% |

| | | | Com. Ex. 1 | Com. Ex. 2 | Com. Ex. 3 |
|---|---|---|---|---|---|
| | | Raw material alloy | 2 | 2 | 1 |
| Base material | Entire visual field | Area ($\mu m^2$) | 42085 | 42085 | 42085 |
| | Voids | Number | 133 | 133 | 127 |
| | | Average area ($\mu m^2$) | 0.76 | 0.76 | 0.72 |
| | | Total area ($\mu m^2$) | 101.08 | 101.08 | 91.44 |
| | | Void occupancy rate (%) | 0.24% | 0.24% | 0.22% |

<Sintered Magnet After Diffusion>

The sintered magnets before diffusion of Examples 1 to 5 and Comparative Examples 1 to 3 were subjected to a diffusion treatment using the heavy rare earth elements presented in Table 5 by the following method to obtain the sintered magnets after diffusion of Examples 1 to 5 and Comparative Examples 1 to 3. First, heavy rare earth compounds were coated on the surfaces of the sintered magnets before diffusion of Examples 1 to 5 and Comparative Examples 1 to 3. As the heavy rare earth compound, $TbH_2$ and Dy—Fe were used. Subsequently, the sintered magnet before diffusion having the heavy rare earth compound attached to its surface were subjected to a heat treatment at 900° C. for 30 hours to obtain sintered magnets after diffusion of Examples 1 to 5 and Comparative Examples 1 to 3. The EPMA images in a cross section perpendicular to the diffusion surface of the sintered magnets after diffusion thus obtained were acquired, the number of the first grain boundary phases, and the number of the second grain boundary phases, and the average area and occupancy rate of the first grain boundary phase and second grain boundary phase were acquired, respectively, and the area ratio between the first and second grain boundary phases (area of first grain boundary phase/area of second grain boundary phase) was calculated. The results thereof are presented in Table 4.

The residual magnetic flux density (Br) and the coercive force (HcJ) of the sintered magnets thus obtained were measured by using a direct-current type BH tracer. Furthermore, a change in coercive force from the sintered magnet before diffusion (ΔHcj, coercive force of sintered magnet after diffusion—coercive force of sintered magnet before diffusion) was calculated. The results thereof are presented in Table 5.

In all Examples, Tb and Dy are coated at 1.0 mass % with respect to the total mass of the sintered magnet before diffusion, respectively, but ΔHcj is greater in Examples than in Comparative Examples in all the cases in which the same heavy rare earth element is coated.

In addition, when Examples are compared with one another, ΔHcj is greater in Example 3 (the occupancy rate of the first grain boundary phase is 1.0% or less) than in Example 4 (the occupancy rate of the first grain boundary phase is 1.8% or less) and ΔHcj is greater in Example 1 (the occupancy rate of the first grain boundary phase is 0.5% or less) than in Example 3.

Furthermore, Hk/HcJ (a value obtained by dividing the magnetic field Hk when the magnetic flux density decreased by 10% from the residual magnetic flux density by HcJ) was measured, and the value of Hk/Hcj and the square shape property were favorable in all Examples.

TABLE 4

| | | Ex. 1 | Ex. 2 | Ex. 3 | Ex. 4 | Ex. 5 | Com. Ex. 1 | Com. Ex. 2 | Com. Ex. 3 |
|---|---|---|---|---|---|---|---|---|---|
| Entire visual field | Area ($\mu m^2$) | 10484 | 10484 | 10484 | 10484 | 10484 | 10484 | 10484 | 10484 |
| First grain boundary phase | Number | 4 | 4 | 12 | 24 | 12 | 36 | 36 | 36 |
| | Average area ($\mu m^2$) | 6.71 | 7.08 | 5.59 | 5.90 | 6.01 | 5.85 | 5.49 | 5.65 |
| | Total area ($\mu m^2$) | 26.84 | 28.32 | 67.12 | 141.56 | 72.12 | 210.76 | 197.60 | 203.40 |
| | Occupancy rate (%) | 0.256 | 0.27 | 0.64 | 1.35 | 0.69 | 2.94 | 1.884 | 1.94 |
| Second grain boundary phase | Number | 80 | 84 | 72 | 56 | 68 | 28 | 32 | 32 |
| | Average area ($\mu m^2$) | 3.00 | 2.81 | 2.93 | 2.94 | 2.88 | 3.07 | 2.95 | 2.95 |
| | Total area ($\mu m^2$) | 240.40 | 235.92 | 210.76 | 164.64 | 195.84 | 86.00 | 94.36 | 94.40 |
| | Occupancy rate (%) | 2.293 | 2.25 | 2.01 | 1.57 | 1.87 | 0.82 | 0.90 | 0.90 |
| Ratio of area of first grain boundary phase to area of second grain boundary phase | Area ratio | 0.11 | 0.12 | 0.32 | 0.86 | 0.37 | 3.59 | 2.09 | 2.15 |

TABLE 5

| | Heavy rare earth element | ΔHcj (kA/m) | Br (mT) | Hcj (kA/m) | Hk/Hcj (%) | Hcj of base material (kA/m) |
|---|---|---|---|---|---|---|
| Example 1 | Tb | 771 | 1435 | 1974 | 95.16 | 1203 |
| Example 2 | Dy | 472 | 1429 | 1675 | 94.58 | 1203 |
| Example 3 | Tb | 714 | 1433 | 1913 | 94.58 | 1199 |
| Example 4 | Tb | 629 | 1430 | 1825 | 94.25 | 1196 |
| Example 5 | Tb | 712 | 1426 | 1899 | 93.91 | 1187 |
| Comparative Example 1 | Tb | 525 | 1427 | 1714 | 93.94 | 1189 |
| Comparative Example 2 | Dy | 323 | 1421 | 1512 | 93.81 | 1189 |
| Comparative Example 3 | Tb | 532 | 1432 | 1730 | 94.78 | 1198 |

Figure 2A:
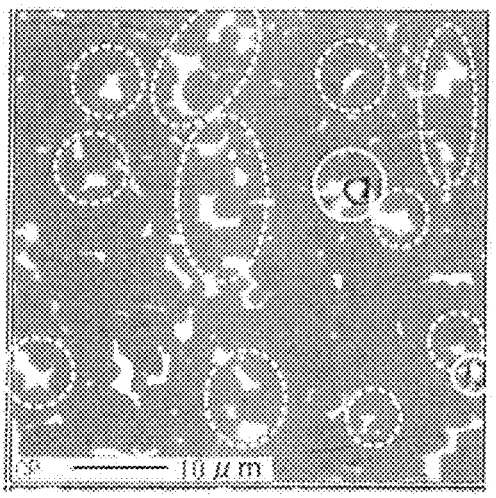
FIGS. 2A to 2D are EPMA images in a cross section perpendicular to a diffusion surface of a sintered magnet after diffusion of Example 1.
Figure 2B:
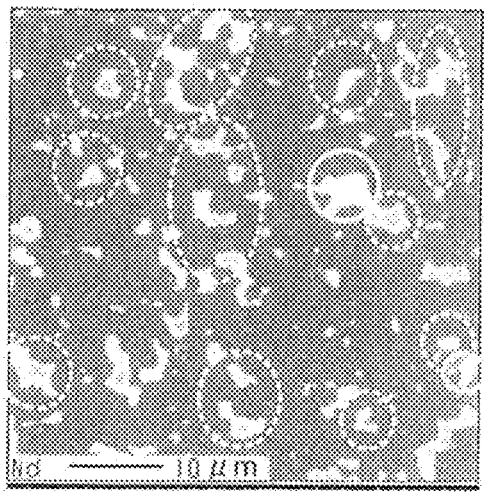
Figure 2C:
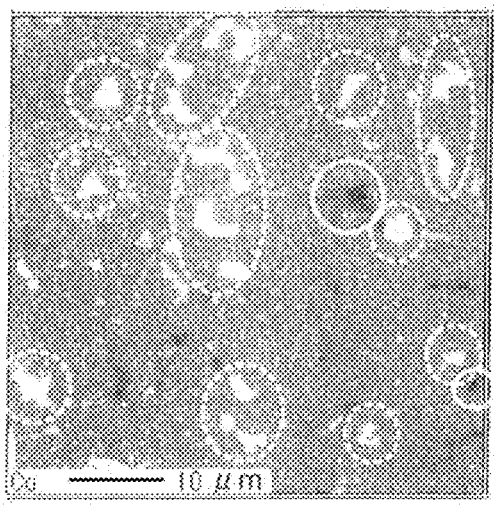
Figure 2D:
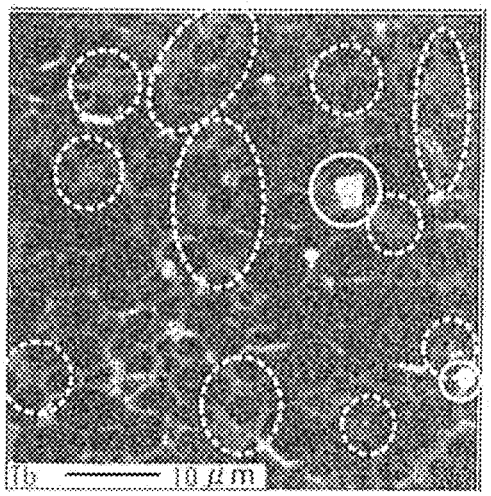

The EPMA images of the cross section perpendicular to the diffusion surface of the sintered magnet after diffusion of Example 1 are illustrated in FIGS. 2A to 2D. Incidentally, FIG. 2A illustrates the compositional image, FIGS. 2B to 2D illustrate the mapped images of Nd, Co, and Tb, respectively, the concentration of the corresponding element is higher at the white portion than its surroundings in the figure, and the concentration of the corresponding element is even higher at the light gray portion surrounded by white. On the other hand, the concentration of the corresponding element is lower at the dark portion than its surroundings in the figure.

Figure 3A:
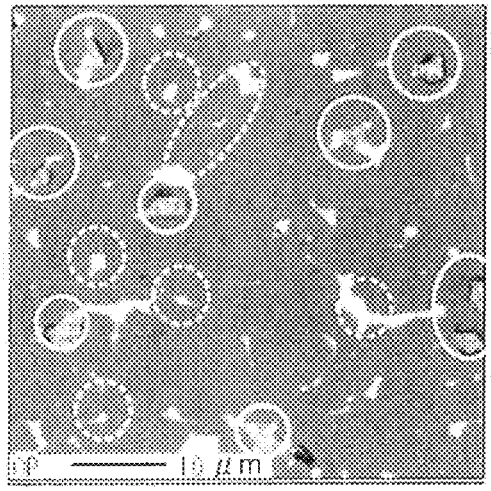
FIGS. 3A to 3D are EPMA images in a cross section perpendicular to a diffusion surface of a sintered magnet after diffusion of Comparative Example 1.
Figure 3B:
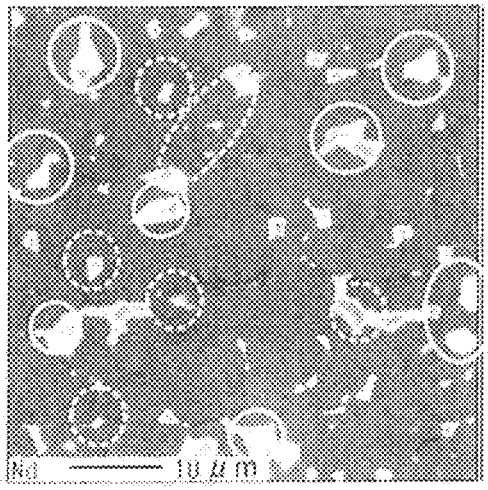
Figure 3C:
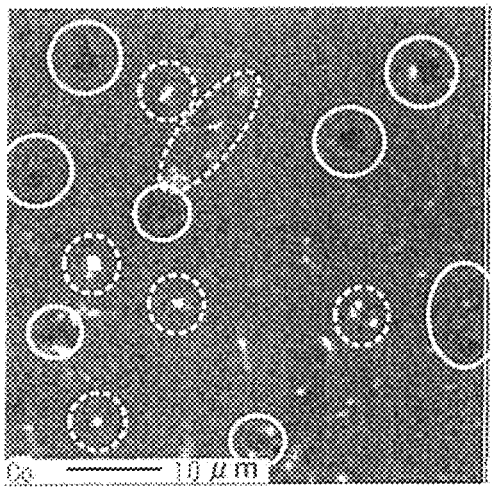
Figure 3D:
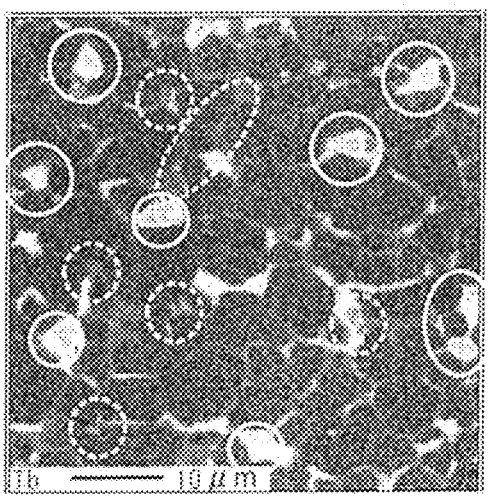
Figure 4:
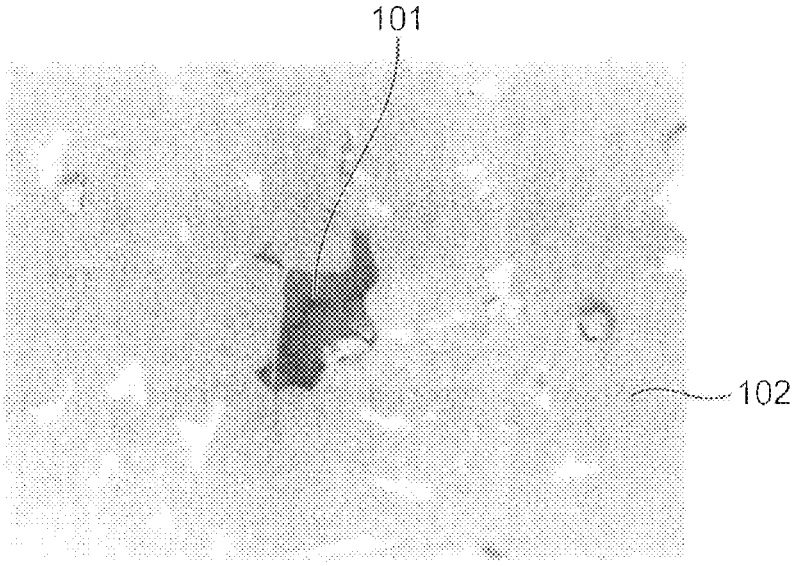
FIG. 4 is a SEM photograph of voids in a conventional R-T-B based sintered magnet.

In addition, the EPMA images of the cross section perpendicular to the diffusion surface of the sintered magnet after diffusion of Comparative Example 1 are illustrated in FIGS. 3A to 3D. Incidentally, FIG. 3A illustrates the compositional image and FIGS. 3B to 3D illustrate the mapped images of Nd, Co, and Tb, respectively, in the same manner as in FIGS. 2A to 2D. As it is apparent from comparison between FIGS. 2A to 2D and FIGS. 3A to 3D, the number of first grain boundary phases (portions surrounded by a solid line) derived from voids is small and a great number of second grain boundary phases (portions surrounded by a broken line) is observed in the sintered magnet after diffusion of Example 1, but the number of first grain boundary phases derived from voids is great and the number of second grain boundary phases is small in the magnet after diffusion of Comparative Example 1.

EXPLANATIONS OF LETTERS OR NUMERALS

1 . . . Void, 2 and 4 . . . Sintered magnet before diffusion, 101 . . . Void, and 102 . . . Sintered magnet after diffusion.

What is claimed is:

1. An R-T-B based sintered magnet comprising a first heavy rare earth element, wherein R includes Nd, T includes Co and Fe, the first heavy rare earth element includes Tb or Dy, the R-T-B based sintered magnet comprises a region having a concentration of the first heavy rare earth element decreasing from a surface toward an inside, a first grain boundary phase which contains the first heavy rare earth element and Nd but does not contain Co is present in one cross section including the region, and an area occupied by the first grain boundary phase in the cross section is 1.35% or less.

2. The R-T-B based sintered magnet according to claim 1, wherein a second grain boundary phase which contains Nd and Co but does not contain the first heavy rare earth element is further present in the region and a ratio of an area of the first grain boundary phase to an area of the second grain boundary phase is 2.0 or less.

3. The R-T-B based sintered magnet according to claim 1, further comprising a second heavy rare earth element, wherein the second heavy rare earth element is substantially uniformly contained over the entire grain boundary phase of the R-T-B based sintered magnet and is a different kind of element from the first heavy rare earth element.

4. The R-T-B based sintered magnet according to claim 1, wherein a second grain boundary phase of a multiparticle grain boundary phase which contains Nd and Co and has a substantially uniform concentration of the first heavy rare earth element is further present in the region and a ratio of an area of the first grain boundary phase to an area of the second grain boundary phase is 2.0 or less.

5. The R-T-B based sintered magnet according to claim 2, further comprising a second heavy rare earth element, wherein the second heavy rare earth element is substantially uniformly contained over the entire grain boundary phase of the R-T-B based sintered magnet and is a different kind of element from the first heavy rare earth element.

6. The R-T-B based sintered magnet according to claim 1, wherein the area occupied by the first grain boundary phase in the cross section is 0.69% or less.

7. A sintered magnet, wherein a first heavy rare earth element contained in a heavy rare earth compound is diffused from a surface toward an inside of an R-T-B based sintered magnet by attaching the heavy rare earth compound to at least a part of the surface of the R-T-B based sintered magnet and heating the heavy rare earth compound, wherein R includes Nd, T includes Co and Fe, the first heavy rare earth element includes Tb or Dy, a first grain boundary phase which contains the first heavy rare earth element and Nd but does not contain Co is present in one cross section including a region having the first heavy rare earth element diffused, an area occupied by the first grain boundary phase in the cross section is 1.35% or less, a second grain boundary phase which contains Nd and Co but does not contain the first heavy rare earth element is further present in the region, and a ratio of an area of the first grain boundary phase to an area of the second grain boundary phase is 2.0 or less.

8. The sintered magnet according to claim 7, wherein the R-T-B based sintered magnet contains a second heavy rare earth element.

9. The R-T-B based sintered magnet according to claim 7, wherein the area occupied by the first grain boundary phase in the cross section is 0.69% or less.

* * * * *